US005289354A

United States Patent [19]

Clayer et al.

[11] Patent Number: 5,289,354

[45] Date of Patent: Feb. 22, 1994

[54] METHOD FOR ACOUSTIC TRANSMISSION OF DRILLING DATA FROM A WELL

[75] Inventors: Frederic Clayer, Jurancon; Henry Henneuse; Jean Sancho, both of Billere, all of France

[73] Assignee: Societe Nationale Elf Aquitaine (Production), France

[21] Appl. No.: 77,520

[22] PCT Filed: Aug. 30, 1991

[86] PCT No.: PCT/FR91/00698

§ 371 Date: Apr. 29, 1992

§ 102(e) Date: Apr. 29, 1992

[87] PCT Pub. No.: WO92/04644

PCT Pub. Date: Mar. 19, 1992

Related U.S. Application Data

[63] Continuation of Ser. No. 849,362, Apr. 29, 1992, abandoned.

[30] Foreign Application Priority Data

Aug. 31, 1990 [FR] France ..... 90 10910

[51] Int. Cl.[5] ..... G01V 1/40

[52] U.S. Cl. ..... 367/82; 367/83; 340/854.4

[58] Field of Search ..... 367/81, 82, 83; 175/48; 340/854.3, 854.4

[56] References Cited

U.S. PATENT DOCUMENTS

| | | | |
|---|---|---|---|
| 3,252,225 | 5/1966 | Hixson | 367/82 |
| 3,845,837 | 11/1974 | McEvers, Jr. et al. | 367/82 |
| 4,027,282 | 5/1977 | Jeter | 367/85 |
| 4,715,451 | 12/1987 | Bseisu et al. | 175/40 |
| 4,733,232 | 3/1988 | Grosso | 340/861 |
| 4,733,233 | 3/1988 | Grosso et al. | 340/861 |
| 4,878,206 | 10/1989 | Grosso et al. | 367/83 |
| 4,992,997 | 2/1991 | Bseisu | 367/82 |
| 5,038,614 | 8/1991 | Bseisu et al. | 73/592 |
| 5,130,951 | 7/1992 | Kingman | 367/82 |

FOREIGN PATENT DOCUMENTS

| | | |
|---|---|---|
| 8910573 | 11/1989 | PCT Int'l Appl. . |
| 2142679 | 1/1985 | United Kingdom . |

*Primary Examiner*—Ian J. Lobo

*Attorney, Agent, or Firm*—Bacon & Thomas

[57] ABSTRACT

A method for transmitting data from the bottom of a well to the surface is disclosed. The method includes measuring data indicative of at least one drilling condition at the bottom of a well, transmitting into a stream of drilling mud injected into a well pipe string a series of encoded pressure pulses representative of the data measurement, and detecting the encoded pulses at the surface using a pressure sensor which is in communication with the stream of drilling mud as it is being injected into an inlet of the pipe string. The method also includes, as a way of improving data detection, using a surface sensor to measure vibrations in the pipe string which are generated as a result of the propogation of the encoded pulses through the drilling mud.

3 Claims, 2 Drawing Sheets

METHOD FOR ACOUSTIC TRANSMISSION OF DRILLING DATA FROM A WELL

This application is a continuation of application Ser. No. 07/849,362 filed Apr. 29, 1992 now abandoned.

The present invention relates to a method for transmission of drilling data from a well, from the bottom to the surface and, more particularly, to such a method using two parallel transmission channels between the bottom and the surface.

During the drilling of a well, for example an oil well, it is desirable for the head driller to know the conditions existing at the bottom of the well (deflection factors, rotation speed of the bit, weight on the bit, torque on the bit, temperature, accelerations etc.) in order better to control the parameters of the drilling. It is preferable to know these conditions in real time, which requires means for transmitting the data from the bottom of the well to the surface.

Knowing the conditions of the bottom of the well permits more rapid drilling and reduction in the costs of drilling. In addition, the head driller will have the possibility of rapidly reacting to any change in conditions, for example change in the type of rock or wear of the bit.

Several means for transmitting data from the bottom to the surface have been proposed. Among these means are transmission by electrical conductor and by acoustic or electromagnetic waves. Data transmission by pressure waves in the drilling mud has also been proposed. In such a system, the pressure of the mud travelling along the string of pipe is modulated, for example, by the agency of a servovalve mounted in a subassembly disposed in the string of pipe adjacent to the bit.

The transmission speed of the signal in such a system is not very high, the pressure waves propagating only at approximately 1500 m/s. Taking into account the deterioration of the waves between the bottom and the surface, inherent limitations in the modulation of the pressure of the mud and the necessity of maintaining the quality of the data at the surface, the data rate remains low.

The object of the present invention is to overcome the drawbacks of transmission of data by pressure waves in the drilling mud by providing a method for transmission of data which is simple and of increased reliability.

In order to do this, the invention proposes a method for transmission of data on the drilling conditions of a well, from the bottom to the surface, comprising the following operations:

- continuous measurement of the pressure of the drilling mud at its inlet into the well;
- measurement of at least one operating condition at the bottom of the well by means of a sensor;
- transmission in the form of pulses which are initiated in the drilling mud and are encoded for the said measurement;
- detection, by pressure measurement, of the pulses in the mud at its inlet into the well;

characterised in that the method comprises the additional operation of simultaneous detection of the vibrations generated in the string of pipe by the said pulses in the drilling mud.

Other characteristics and advantages of the present invention will emerge more clearly from reading the description hereinbelow with reference to the attached drawings in which.

Figure 1:
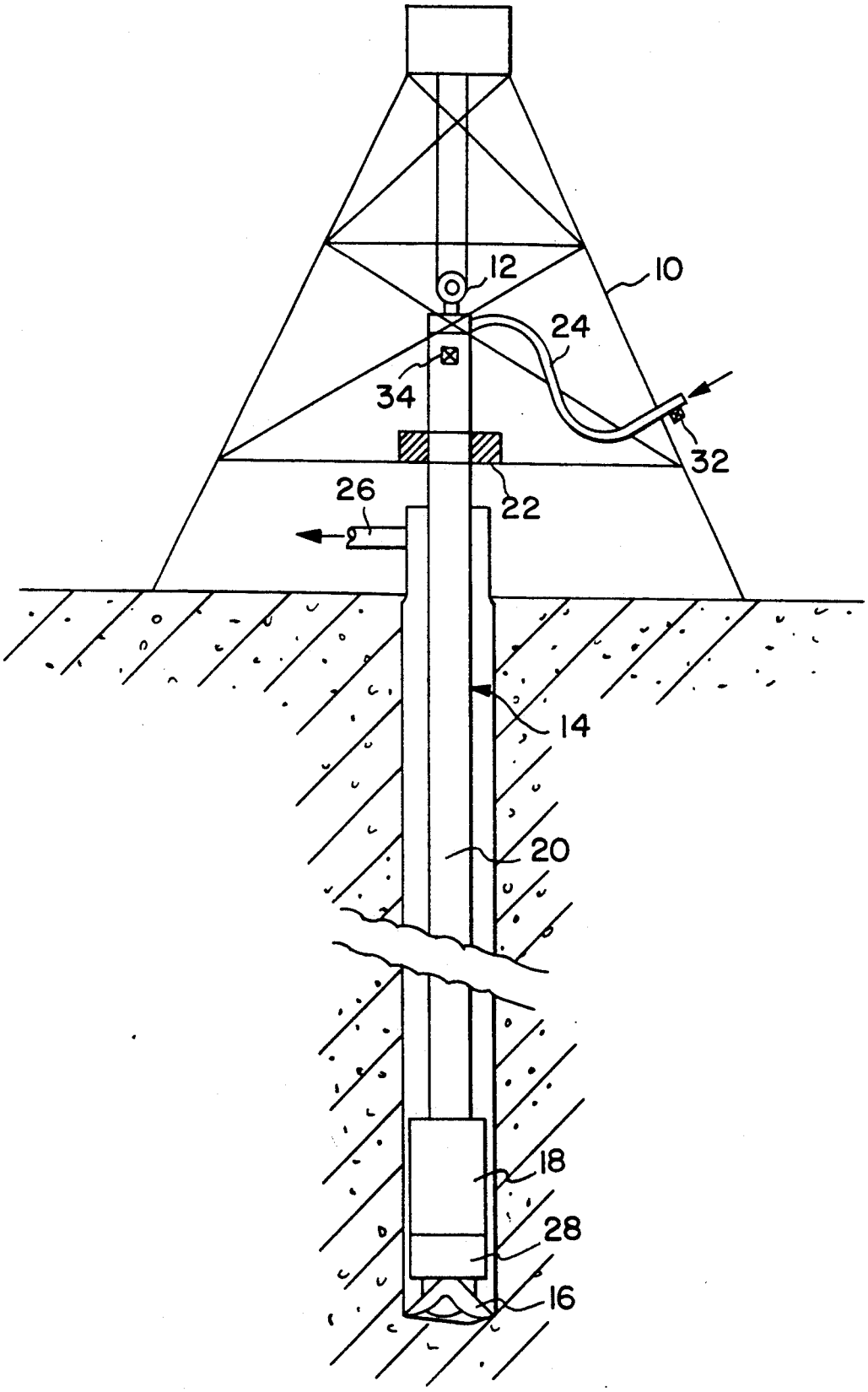
FIG. 1 is a diagrammatic sectional view of a drilling assembly.

In FIG. 1 is shown a drilling assembly comprising a mast 10 fitted, in a manner known per se, with a hook 12 to which is suspended a string of pipe shown generally by 14. The string of pipe 14 comprises a drill bit 16, drill collars 18 and drill pipes 20. In the example illustrated, the string of pipe 14 is rotated by a rotary turntable 22 or by a motorised head called a "power swivel". The pressurised drilling mud passes from a source (not shown) inside the pipes 20 by a hose 24. This mud is recycled back to storage tanks (not shown) via a conduit 26. A servovalve mounted in a subassembly 28 disposed adjacent to the bit 16 is intended to interrupt selectively the flow of the pressurised mud in order to create pressure waves in the mud. Measurement and control devices are disposed in the subassembly 28 enabling, in a known fashion, to generate pressure waves in the mud which are representative of the measurements taken at the bottom. These pressure waves are detected at the surface by a pressure sensor 32 which is mounted on the hose 24.

The pressure waves created in the mud also generate corresponding vibrations in the string of pipe 14. According to the invention, it has been found that the reading of the data could be improved by mounting a second sensor on the string of pipe.

As shown in FIG. 1, the drilling assembly comprises, in addition, an accelerometer 34 mounted on the upper end of the string of pipe 14 and intended to measure the longitudinal acceleration of the pipes 20.

Figure 2:
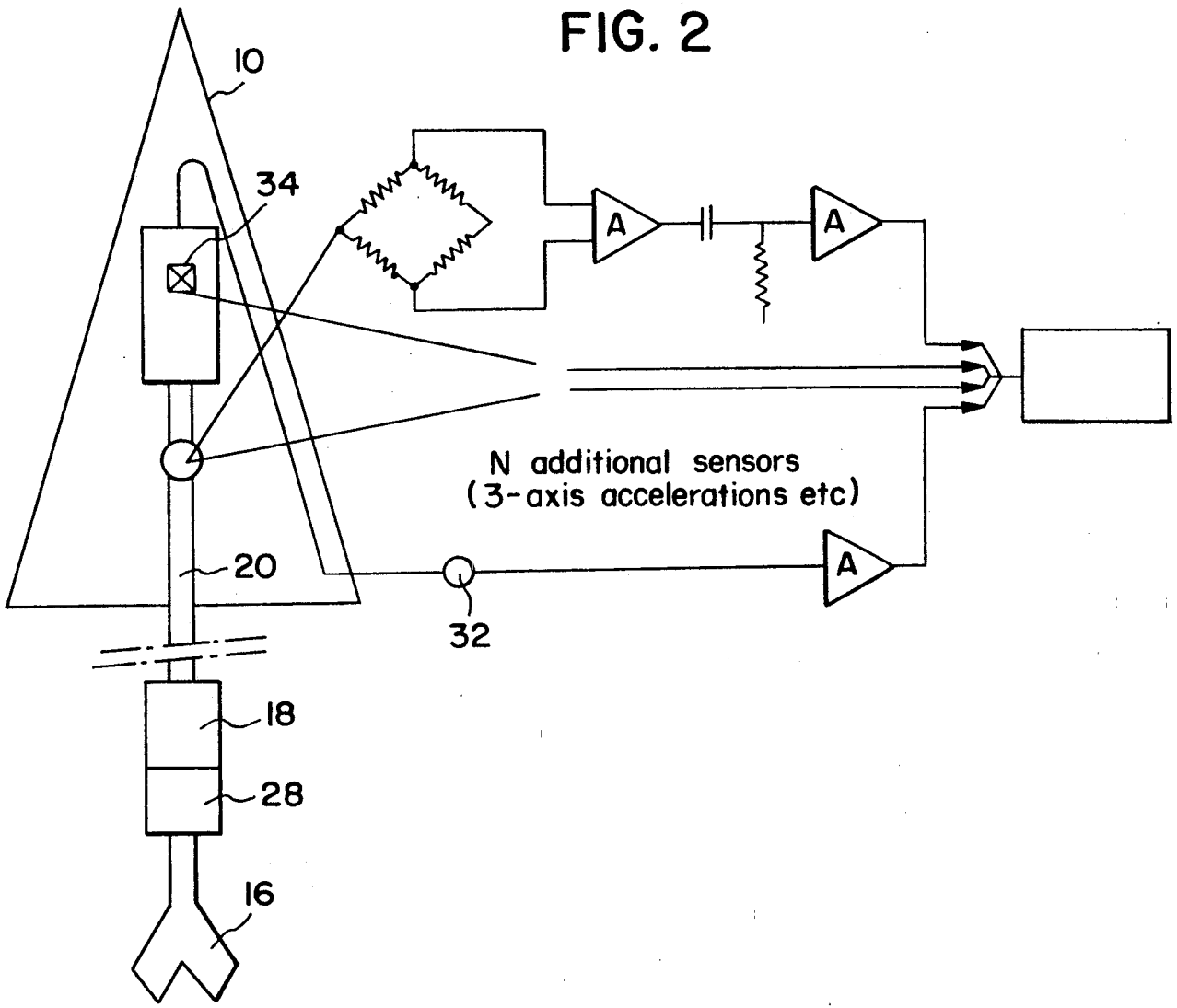
FIG. 2 shows diagrammatically a processing circuit.

The circuit for processing the signals generated by the sensor 32 and the accelerometer 34 is shown diagrammatically in FIG. 2.

It is also possible to use an axial tension (or strain) gauge disposed on the upper end of the string of pipe 14, either to replace the accelerometer 34 or to provide additional data. In the latter case, the data provided by the additional gauge serves to further reduce the effects of parasitic noise. These data are processed by a parallel channel in the diagram of FIG. 2.

In order to minimise the effects of parasitic noise, it is possible to make provision for adding other gauges in order to detect, for example, the radial accelerations of the upper end of the string of pipe.

In each case, the signals produced by the various sensors are processed in the circuit of FIG. 2. As the propagation speed of the waves in the material of the string of pipe is at least three times greater than that in the drilling mud, the processing circuit must permit a timing realignment of the signals.

This realignment may be carried out either by intercorrelation of the signals or from a knowledge of the speeds in the two media.

Next, it is recommended to perform a weight averaging of the signals in the time domain. A quality index is applied which is established for each data channel by reference, for example, to a surface clock. This enables a respective significance to be attributed to each data channel and can lead to the abandonment of one channel. An overall quality index could also be calculated from the incoherences between the separately decoded signals.

In addition, whilst realigning the data channels, it is possible to perform simultaneously a shifting of the parasitic surface signals, especially the noise from the pumps. The averaging operation will then reduce this parasitic noise.

We claim:

1. Method for transmission of data on the drilling conditions of a well having a string of drill pipe, from the bottom to the surface, comprising the following steps:

measuring continuously the pressure of drilling mud as it passes through an inlet into the string of drill pipe;

measuring at least one operating condition at the bottom of the well by means of a sensor;

transmitting encoded signals generated by a single source as fluid pressures pulses in the drilling mud and as axial vibrations in the drill string which are representative of the measured operating condition; and detecting simultaneously the fluid pressure pulses in the mud by a pressure sensor at the inlet into the string of a drill pipe and the axial vibrations generated in the string of drill pipe by an accelerometer which is disposed at the upper end of the string of pipe.

2. Method according to claim 1, wherein two types of vibrations generated in the string of pipe are detected by using the accelerometer and an axial tension gauge disposed at the upper end of the string of pipe.

3. Method according to claim 2, further including the operations of performing timing realignment and weight averaging in the time domain of pressure measurement signals detected at the inlet of the well and vibration signals detected by the accelerometer.

* * * * *